US005323131A

United States Patent [19]

Castonguay

[11] Patent Number: 5,323,131

[45] Date of Patent: Jun. 21, 1994

[54] MOLDED CASE CIRCUIT BREAKER MOTOR OPERATOR

[75] Inventor: Roger N. Castonguay, Terryville, Conn.

[73] Assignee: General Electric Company, New York, N.Y.

[21] Appl. No.: 23,515

[22] Filed: Feb. 26, 1993

[51] Int. Cl.[5] ..... H01H 3/00

[52] U.S. Cl. ..... 335/68; 335/71

[58] Field of Search ..... 335/65, 68, 69, 70, 335/71, 72

[56] References Cited

U.S. PATENT DOCUMENTS 3,171,920 11/1962 Klein et al. .

3,213,235 10/1965 Soos, Jr. ..... 335/68

3,328,731 6/1967 Huska ..... 335/71

3,474,363 10/1969 Shaffer et al. ..... 335/70

4,982,173 1/1991 Meiners et al. .

4,990,873 2/1991 Grunert et al. ..... 335/68

*Primary Examiner*—Lincoln Donovan

*Attorney, Agent, or Firm*—Richard A. Menelly

[57] ABSTRACT

A molded case circuit breaker motor operator includes a keying arrangement to prevent energizing the circuit breaker unless the motor associated with the motor operator is in the proper operating mode. The keying arrangement is in the form of a rejection plate that interfaces between the circuit breaker operating handle and the motor operator driver plate.

16 Claims, 5 Drawing Sheets

FIG. 3A
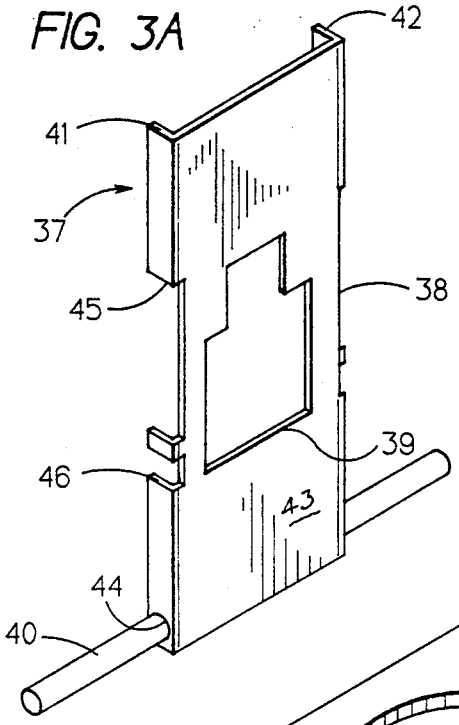
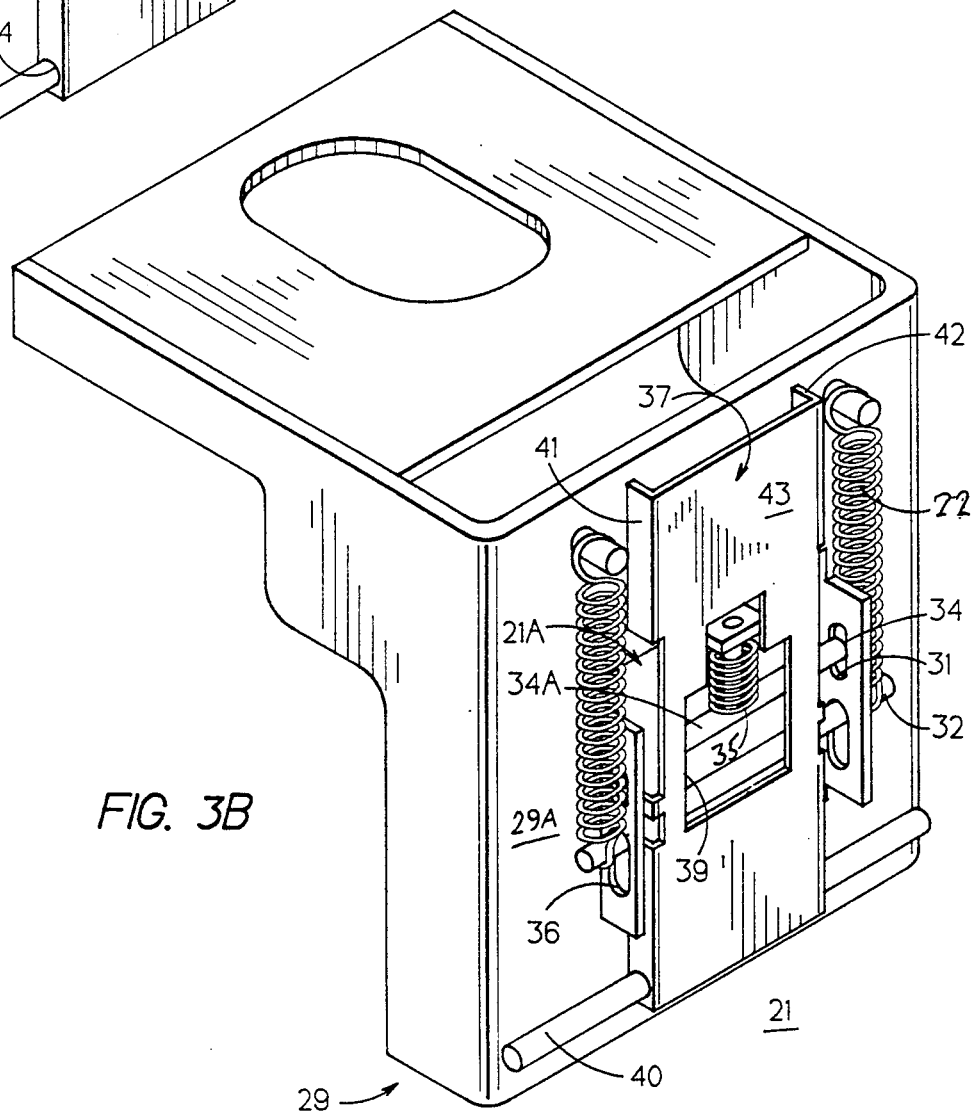
FIG. 3B

MOLDED CASE CIRCUIT BREAKER MOTOR OPERATOR

BACKGROUND OF THE INVENTION

Molded case industrial-rated circuit breakers such as described within U.S. Pat. No. 4,982,173 employ a pair of separable contacts and an operating mechanism wherein the contacts are restrained from being driven to their open position against the bias of a pair of powerful operating mechanism springs under quiescent circuit current conditions. The circuit breaker operating mechanism rapidly drives the contacts to their open positions upon the occurrence of an overcurrent condition. An external operating handle is employed to turn the contacts between open and closed conditions usually to energize associated electrical equipment.

When such a circuit breaker is located at a location remote from the associated equipment, a motor operator device engages the operating handle and moves the handle under driving force provided by a remotely-switched electric motor. U.S. Pat. No. 3,171,920 describes one such motor operator used to control a remote circuit breaker. However, to prevent faulty operation of the motor operator during the installation process, a skilled operator is usually employed to insure that the circuit breaker contacts are open and the circuit breaker operating handle is in the OFF position when the motor operator is in the OFF position and the circuit breaker operating handle is in the ON position when the motor operator is in the ON position to prevent inadvertent damage to the circuit breaker operating handle.

It would be economically feasible to align the motor operator ON and OFF positions with the circuit breaker ON and OFF positions automatically and without requiring any such skilled operator.

Accordingly, the invention proposes an improved motor operator device which can automatically align the motor operator and associated circuit breaker mechanical logic states without human intervention.

SUMMARY OF THE INVENTION

A circuit breaker motor operator device employs an interface plate between the motor operator and the circuit breaker external operating handle to automatically insure alignment between the ON and OFF states of the circuit breaker handle and the ON and OFF states of the motor operator that engages the operating handle. The interface plate is in the form of a rejection plate that is geometrically-configured to allow engagement between the circuit breaker operating handle and the motor operator when the ON and OFF states coincide.

BRIEF DESCRIPTION OF THE DRAWINGS

FIG. 3A is a front perspective view of the motor operator rejection plate according to the invention;

FIG. 3B is a front perspective view of the motor rejection plate of FIG. 3A attached to the motor operator of FIG. 2;

DESCRIPTION OF THE PREFERRED EMBODIMENT

Figure 1:
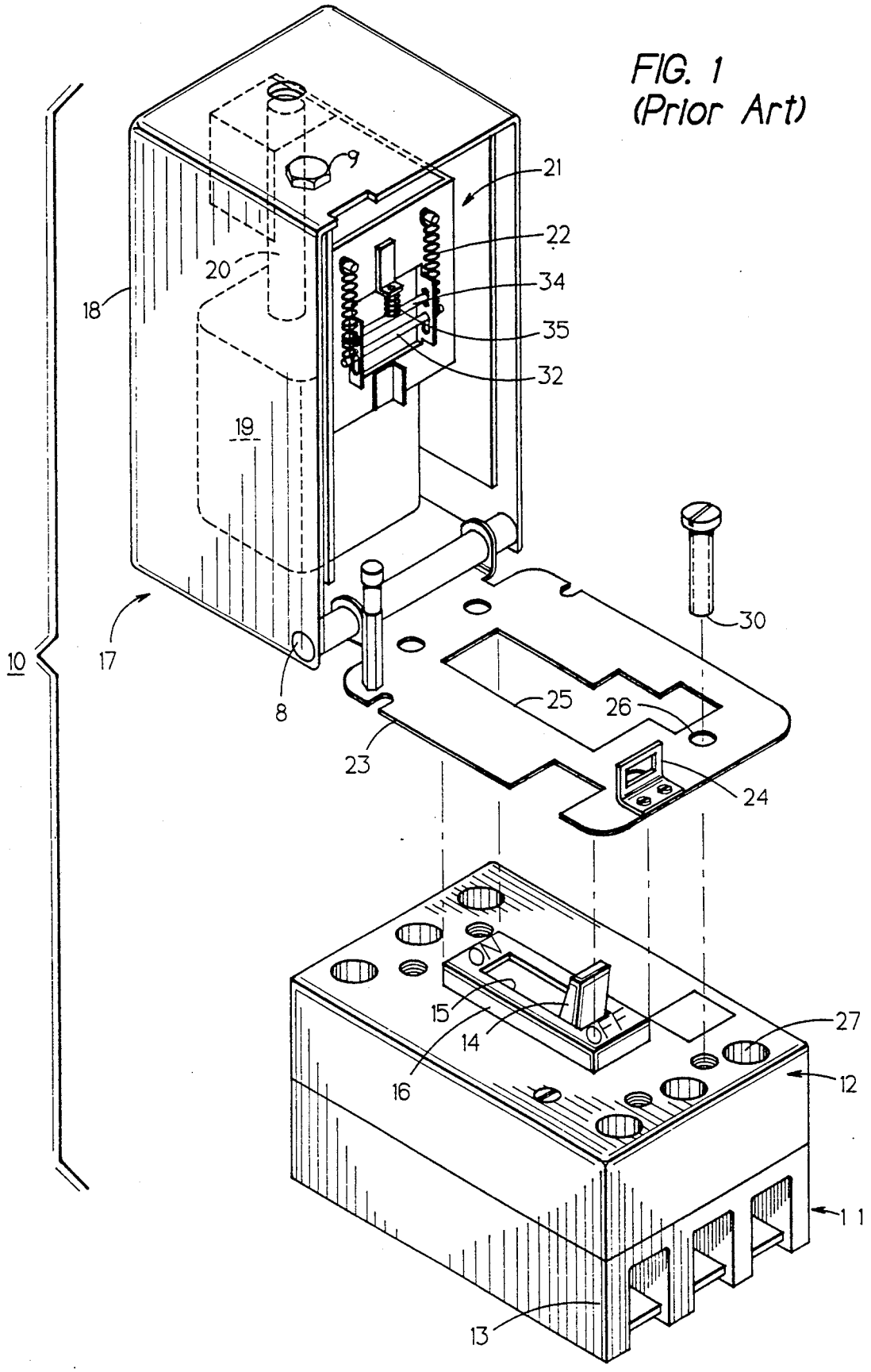
FIG. 1 (Prior Art)
FIG. 1 is a top perspective view of a molded case circuit breaker having a motor operator in isometric projection in accordance with the prior art.

A motor-controlled circuit breaker assembly 10 is shown in Figure I prior to attaching the motor operator 17 to the industrial-rated molded case circuit breaker 11 having a case 13 to which a cover 12 is fixedly attached. An externally accessible operating handle 14 slides between its ON and OFF condition within the slot 15 formed within the handle escutcheon 16 to open and close the internal contacts. The motor operator 17 includes a combined cover-enclosure 18 which contains an electric motor 19 and associated worm gear 20. The worm gear operably-connects with a slide plate assembly 21 that moves the on-off handle drive pins 34, 32 against the return bias of the extension springs 22 and the compression spring 35. As described within the aforementioned U.S. Pat. No. 3,171,920 a circuit breaker cover plate 23, hinged to the cover-enclosure 18 by means of the pivot hinge 8 is attached to the cover of the circuit breaker by means of screws 30, thru-holes 26 and threaded openings 27. The circuit breaker operating handle 14 is captured within the L-shaped slot 25. The latch 24 on the cover plate 23 interacts with the button 9 on the cover-enclosure 18 to releasably hold the cover plate to the cover-enclosure.

Figure 2:
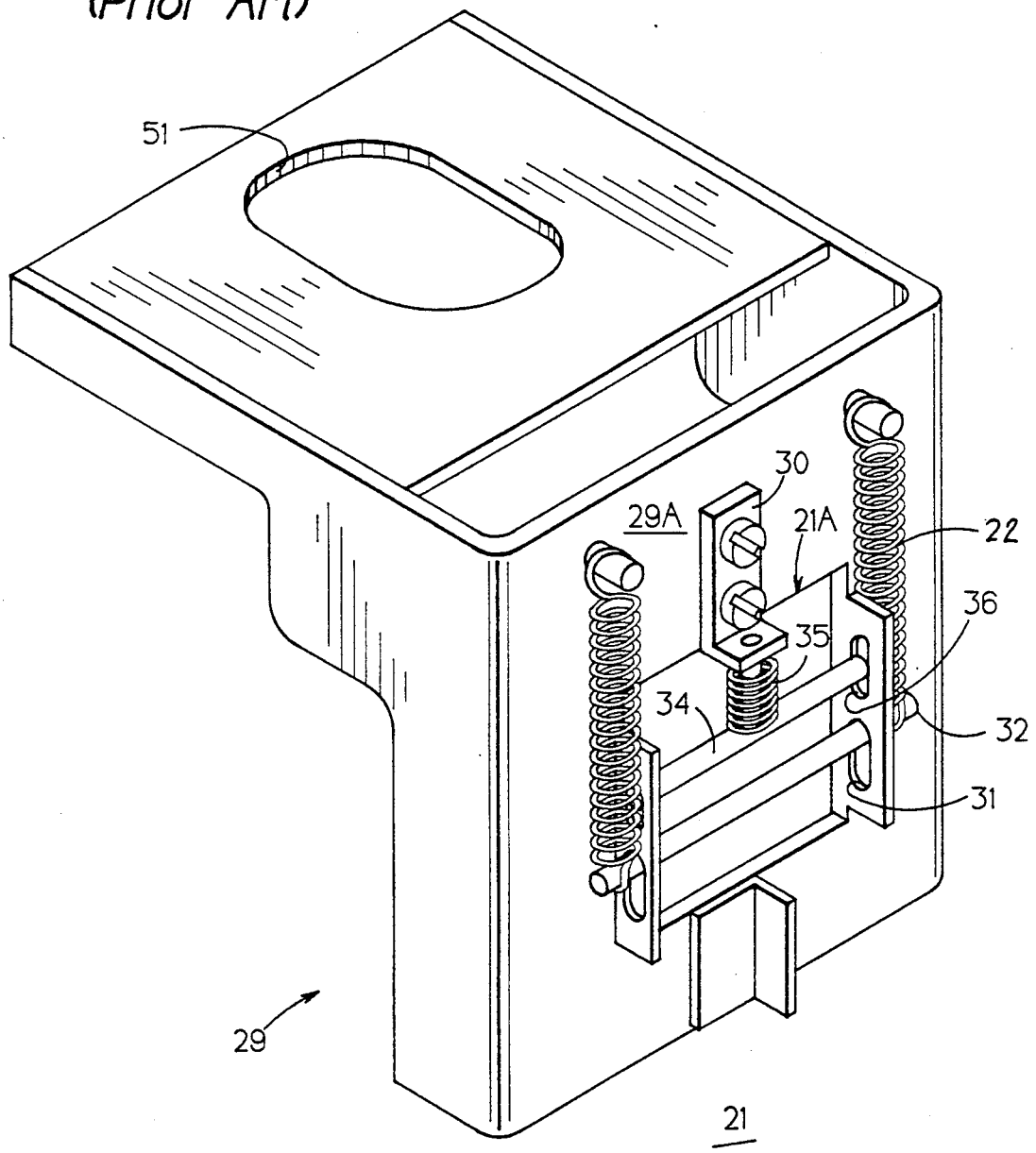
FIG. 2 (Prior Art)
FIG. 2 is an enlarged front perspective view of the motor operator of FIG. 1.

The slide plate assembly 21 is depicted in FIG. 2 to detail the support 29 that carries the on-off circuit breaker operating handle drive pins 34, 32 (hereafter "on off handle drive pins"), extension springs 22 and compression spring 35 that are arranged partially within the cover-enclosure. The screw 30 tightly fastens the L-shaped compression spring retainer plate 33 onto the top surface 29A of the support 29. The aperture 51 provides passage of the motor worm gear 20 shown earlier in FIG. 1.

The rejection plate 37 according to the invention is shown in FIG. 3A to consist of a U-shaped plate 38 defining a pair of opposing sides 41, 42, as indicated. A cruciform slot 39 is formed within the top 43 to provide mechanical logic to the rejection plate as will be described below. Thru-holes 46 formed in the opposing sides receive the off handle drive pin 32 as shown in FIG. 3B to retain the rejection plate to the slide plate assembly 21. Referring now to both FIGS. 3A, 3B, the elongated slot 45 formed in the sides 41, 42, provide clearance motion to the on handle drive pin 34 and the oversized support pin 40 arranged through the slots 44 in the sides 41, 42, provide added support to the rejection plate when mounted on the slide plate assembly support 29. The slots 31, 36, provide clearance to the on, off handle drive pins 34, 32, while the cruciform slot 39 formed in the top 43 of the rejection plate 37 provides access to the center 34A of the on handle drive pin 34 and clearance to the compression spring 35. The extension springs 22 are outboard the rejection plate and cooperate with the off handle drive pin 32 to provide return bias to both the slide plate support 21A as well as the rejection plate 37 simultaneously. In transferring back and forth along the top 29A of the support 29, the sides 41, 42, of the rejection plate serve as runners while the oversized support pin 40 serves as a roller to maintain mechanical contact between the rejection plate 37 and the surface 29A at all times.

Figure 4:
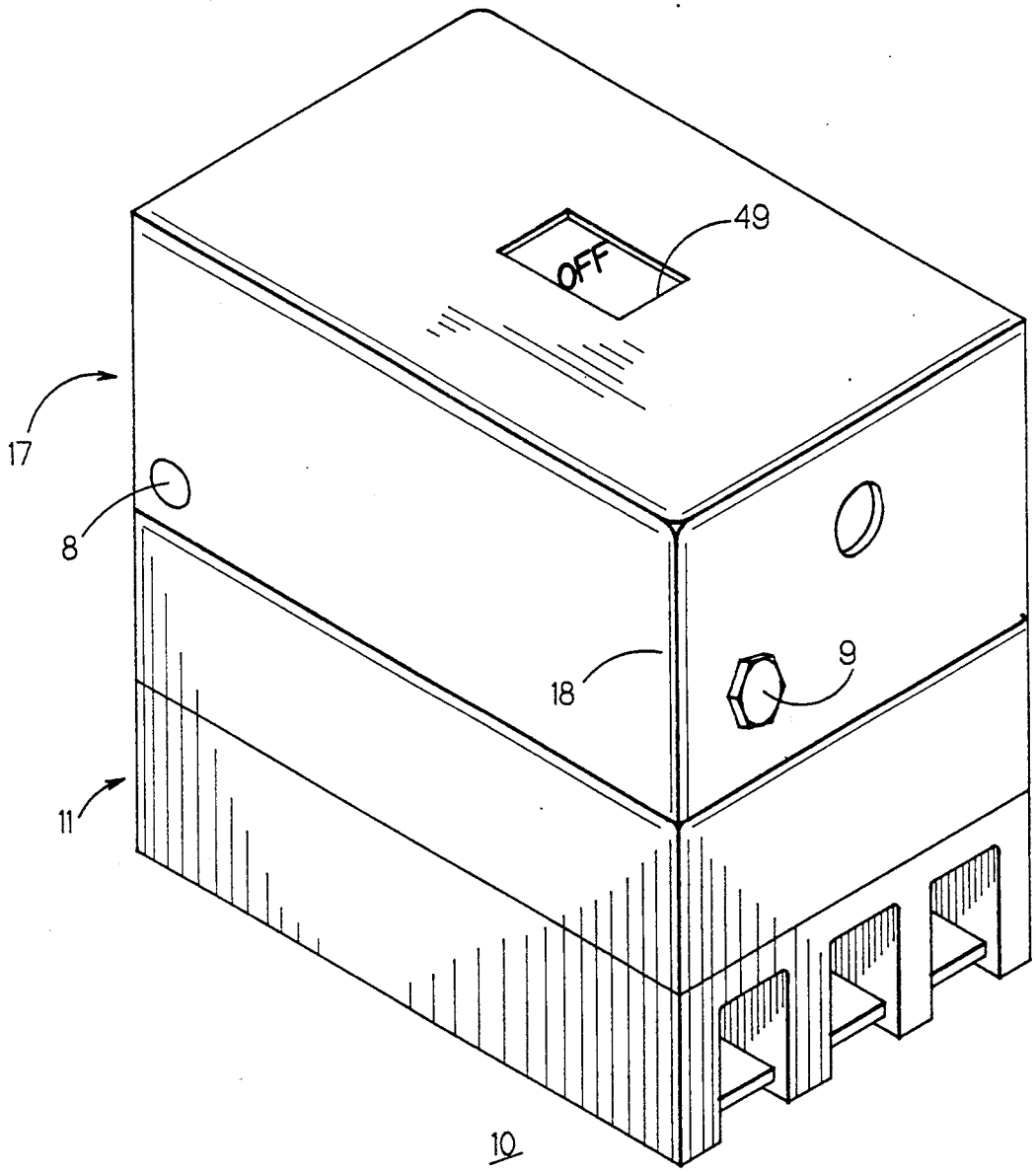
FIG. 4 is a top perspective view of a circuit breaker engaging the motor operator of FIG. 3B.

The motor-operated circuit breaker 10, shown in FIG. 4, is depicted with the motor operator 17 attached to the circuit breaker 11 by means of the hinge pin 8. The release button 9 serves to allow rotation of the cover-enclosure 18 in the counter-clockwise direction about the hinge pin to open the cover-enclosure and in the clockwise direction to close the cover enclosure. The on-off indicating window 49 at the top of the motor operator provides indication of the OFF and ON positions of the on and off handle drive pins and circuit breaker operating handle described earlier.

Figure 5:
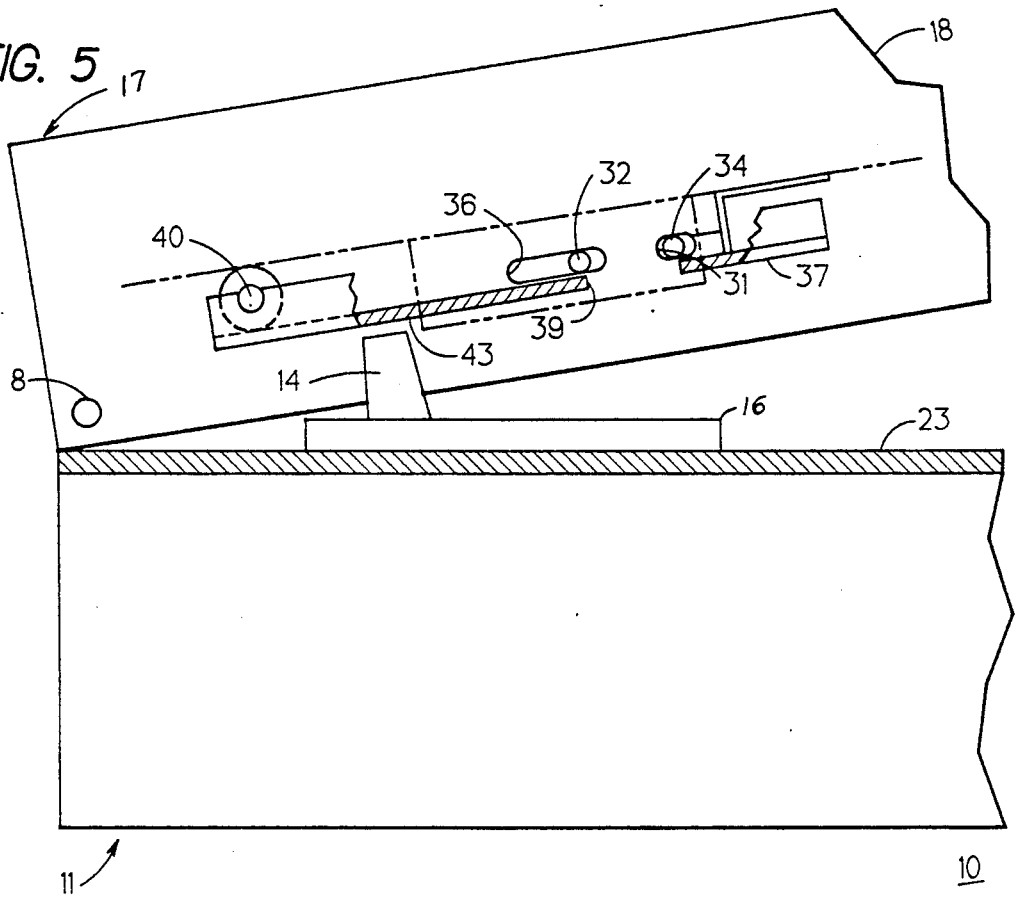
FIG. 5 is a partial side view of the circuit breaker and motor operator of FIG. 4 with the circuit breaker operating handle in the ON position.
Figure 6:
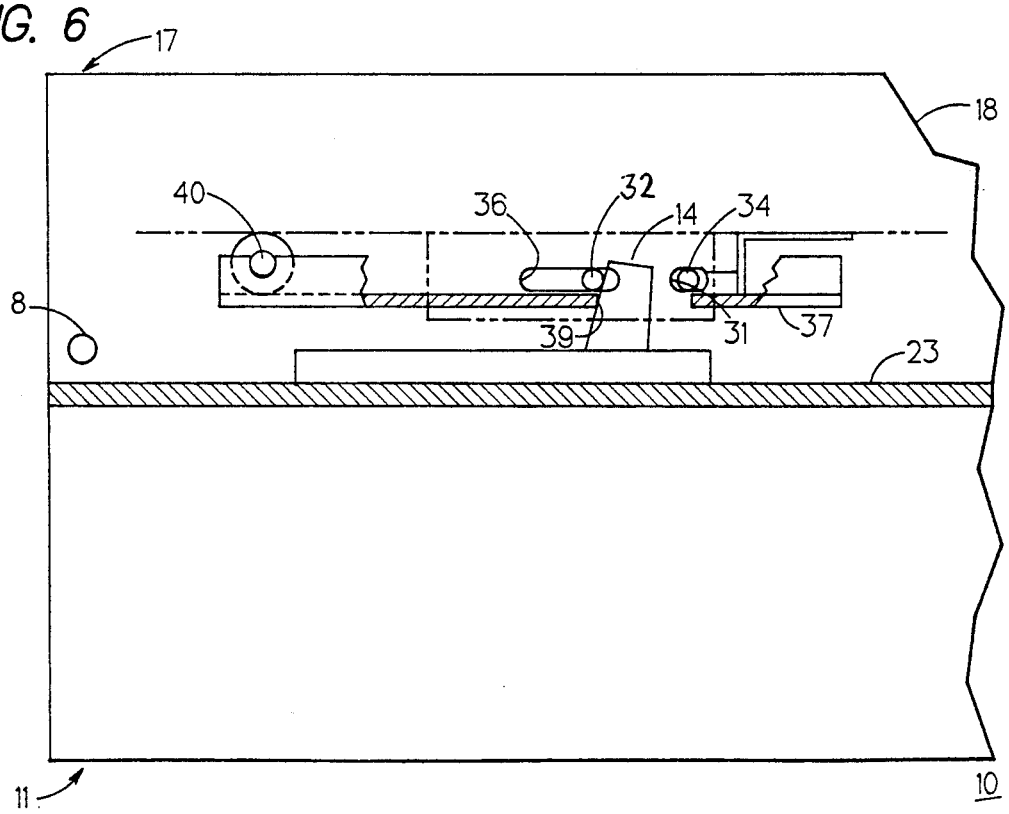
FIG. 6 is a partial side view of the circuit breaker and motor operator of FIG. 4 with the circuit breaker operating handle in the OFF position.

The operation of the rejection plate 37 relative to the circuit breaker operating handle 14 to insure that the circuit breaker operating handle is in the OFF position when the motor operator 17 is in the OFF position as determined by on, off handle drive pins 34, 32 is best seen by referring collectively to FIGS. 5 and 6. In FIG. 5, the circuit breaker handle escutcheon 16 and operating handle 14 on the circuit breaker 11 within the motor-operated circuit breaker 10 extend above the circuit breaker cover plate 23 attached to the cover-enclosure 18 of the motor operator 17 by means of the hinge pin 8. As seen in FIG. 5, the circuit breaker operating handle 14 is in its ON position while the off drive pin 32 is in the OFF position within slot 36 and the on drive pin 34 is in the OFF position within slot 31. This automatically positions the cruciform slot 39 on the rejection plate 37 out of alignment with the circuit breaker operating handle 14 causing the circuit breaker operating handle to bottom against the top 43 of the rejection plate in the vicinity of the oversized support pin 40. The motor operator 17 is accordingly prevented from being closed onto the circuit breaker cover plate 23 and hence prevents false indication of the actual position of the circuit breaker operating handle 14. When the off handle drive pin 32 is in the OFF position within slot 36, the on handle drive pin 34 is in the OFF position within slot 31, and the circuit breaker operating handle 14 is in the OFF position, the cruciform slot 39 on the rejection plate 37 aligns with the circuit breaker operating handle 14 away from the oversized support pin 40 and thereby allows the circuit breaker operating handle to pass within the cruciform slot and allow the motor operator 17 to fully rotate about the hinge pin 8 to the closed position indicated in FIG. 6. The cover-enclosure 18 is in abutment with the rejection plate 23 on the circuit breaker 11 to thereby allow the circuit breaker to perform as the motor-controlled circuit breaker 10.

A motor operator provided with a rejection plate has herein been described whereby the rejection plate interacts with the motor operator on-off handle drive pins to insure that the circuit breaker operating handle is in its true OFF position when the motor operator is in its OFF position.

Having thus described my invention, what I claim as Letters Patent is:

1. A motor operator for molded case circuit breakers comprising:

an enclosure having an open front face;

an electric motor within said enclosure operably connected with a slide plate assembly in abutment with said front face;

a circuit breaker cover plate hinged to a bottom of said enclosure and adapted to be fastened to a circuit breaker cover;

a circuit breaker handle first drive pin on said slide plate assembly biased to a first position by means of a pair of first springs arranged outboard said slide plate assembly; and a rejection plate over said slide plate assembly, said rejection plate including a slot whereby said slot provides access between said circuit breaker drive pin and a circuit breaker operating handle when the circuit breaker first drive pin and the circuit breaker operating handle are both in their OFF positions.

2. The motor operator of claim I including a circuit breaker handle second drive pin on said slide plate biased to a second position by means of a second spring.

3. The motor operator of claim I wherein said slot comprises a cruciform configuration.

4. The motor operator of claim I wherein said rejection plate comprises a U-shaped configuration having a pair of opposing sides.

5. The motor operator of claim 4 including a support pin extending between said opposing sides.

6. The motor operator of claim 5 wherein said sides include a pair of retainer slots, said support pin being retained within said retainer slots at opposite ends thereof.

7. The motor operator of claim 4 wherein said circuit breaker handle first drive pin is retained by both said slide plate assembly and said rejection plate whereby said slide plate assembly and said rejection plate translate in unison.

8. The motor operator of claim I wherein said first spring comprises an extension spring and said second spring comprises a compression spring.

9. A motor-operated molded case circuit breaker comprising:

a motor operator enclosure having an open front face and an electric motor within said enclosure operably connected with a slide plate assembly in abutment with said front face;

a molded case circuit breaker having a circuit breaker cover fixedly attached to a circuit breaker case and an externally-accessible circuit breaker operating handle extending from said cover;

a circuit breaker cover plate hinged to a bottom of said enclosure and fastened to said circuit breaker cover;

a circuit breaker handle first drive pin on said slide plate biased to a first position by means of a pair of first springs arranged outboard said slide plate; and a rejection plate over said slide plate, said rejection plate including a slot whereby said slot provides access between said circuit breaker drive pin and said circuit breaker operating handle when said circuit breaker first drive pin and said circuit breaker operating handle are both in their OFF positions.

10. The motor-operated molded case circuit breaker motor operator of claim 9 including a circuit breaker handle second drive pin on said slide plate biased to a second position by means of a second spring.

11. The motor-operated molded case circuit breaker of claim 9 wherein said slot comprises a cruciform configuration.

12. The motor-operated molded case circuit breaker of claim 9 wherein said rejection plate comprises a U-shaped configuration having a pair of opposing sides.

13. The motor-operated molded case circuit breaker of claim 12 including a support pin extending between said opposing sides.

14. The motor-operated molded case circuit breaker of claim 13 wherein said sides include a pair of retainer slots, said support pin being retained within said retainer slots, at opposite ends thereof.

15. The motor-operated molded case circuit breaker of claim 9 wherein said circuit breaker handle first drive pin is retained by both said slide plate assembly and said rejection plate whereby said slide plate assembly and said rejection plate translate in unison.

16. The motor-operated molded case circuit breaker of claim 9 wherein said first springs comprise extension springs and said second spring comprises a compression spring.

* * * * *